US010876544B2

(12) United States Patent
Matsueda

(10) Patent No.: US 10,876,544 B2
(45) Date of Patent: Dec. 29, 2020

(54) ROTARY MACHINE AND DIAPHRAGM

(71) Applicant: MITSUBISHI HEAVY INDUSTRIES COMPRESSOR CORPORATION, Tokyo (JP)

(72) Inventor: Takanori Matsueda, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 100 days.

(21) Appl. No.: 16/170,169

(22) Filed: Oct. 25, 2018

(65) Prior Publication Data

US 2019/0136869 A1 May 9, 2019

(30) Foreign Application Priority Data

Nov. 9, 2017 (JP) ..... 2017-216290

(51) Int. Cl.

| | |
|---|---|
| ***F04D 29/44*** | (2006.01) |
| ***F04D 17/12*** | (2006.01) |
| ***F04D 29/42*** | (2006.01) |
| ***F04D 29/28*** | (2006.01) |

(52) U.S. Cl.

CPC ..... *F04D 29/441* (2013.01); *F04D 17/122* (2013.01); *F04D 29/286* (2013.01); *F04D 29/4206* (2013.01); *F04D 29/444* (2013.01)

(58) Field of Classification Search

CPC .... F04D 29/4206; F04D 29/44; F04D 29/441; F04D 29/444; F04D 29/286; F04D 17/122

See application file for complete search history.

(56) References Cited

U.S. PATENT DOCUMENTS 2,108,786 A * 2/1938 Bigelow ..... F04D 1/063 415/199.1
2,365,310 A * 12/1944 Wislicenus ..... F04D 29/185 416/186 R
2,604,257 A * 7/1952 Haeberlein ..... F04D 17/122 415/112
3,051,090 A * 8/1962 Zumbusch ..... F04D 1/063 415/199.1
3,103,892 A * 9/1963 McFarland ..... F04D 1/063 415/185

(Continued)

*Primary Examiner* — David E Sosnowski
*Assistant Examiner* — Wayne A Lambert
(74) *Attorney, Agent, or Firm* — Osha Bergman Watanabe & Burton LLP

(57) ABSTRACT

A rotary machine includes a casing part having a return bend part configured to reverse a flow direction of a working fluid flowing from an impeller. The casing part includes a diaphragm having a curved flow path formation surface which forms a curved surface of the return bend part and an outer casing configured to cover the diaphragm and having a concave part which is recessed from an inner circumferential surface. The outer casing has an outer flow path formation surface which forms a part of the return bend part further outward in the radial direction than the curved flow path formation surface. The diaphragm has a convex part which protrudes from an outer circumferential surface outward in the radial direction to be engaged with the concave part. A surface of the convex part in the axial direction extends from the curved flow path formation surface.

6 Claims, 2 Drawing Sheets

(56) References Cited

U.S. PATENT DOCUMENTS

| | | | | |
|---|---|---|---|---|
| 3,825,368 | A * | 7/1974 | Benjamin | F04D 29/624 415/199.2 |
| 3,874,814 | A * | 4/1975 | Carroll | F01D 25/265 415/214.1 |
| 3,942,908 | A * | 3/1976 | Pilarczyk | F02C 6/06 415/199.2 |
| 4,493,611 | A * | 1/1985 | Funakoshi | F01D 9/026 415/199.1 |
| 4,715,778 | A * | 12/1987 | Katayama | F04D 17/122 415/104 |
| 6,203,275 | B1 * | 3/2001 | Kobayashi | F04D 17/122 415/199.2 |
| 6,340,287 | B1 * | 1/2002 | Eino | F04D 29/2222 415/199.1 |
| 7,510,373 | B2 * | 3/2009 | Sarri | F04D 17/122 415/199.1 |
| 8,070,426 | B2 * | 12/2011 | Brunner | F04D 29/44 415/174.3 |
| 8,133,021 | B2 * | 3/2012 | Fingerhut | F04D 29/624 415/213.1 |
| 8,142,151 | B2 * | 3/2012 | Zacharias | F04D 29/083 415/215.1 |
| 8,157,517 | B2 * | 4/2012 | Feher | F04D 17/122 415/199.2 |
| 9,169,846 | B2 * | 10/2015 | Mariotti | F04D 29/057 |
| 2007/0140889 | A1 * | 6/2007 | Chen | F04D 29/441 418/183 |
| 2015/0016988 | A1 * | 1/2015 | Griffin | F04D 29/083 415/214.1 |
| 2016/0032932 | A1 * | 2/2016 | Sorokes | F04D 27/001 415/1 |
| 2017/0030373 | A1 | 2/2017 | Ravi et al. | |

* cited by examiner

ROTARY MACHINE AND DIAPHRAGM

CROSS-REFERENCE TO RELATED APPLICATION

Priority is claimed on Japanese Patent Application No. 2017-216290, filed Nov. 9, 2017, the content of which is incorporated herein by reference.

BACKGROUND

Field

The present disclosure relates to a rotary machine and a diaphragm.

Description of Related Art

A rotary machine such as a centrifugal compressor mainly includes an impeller which rotates about an axis and a casing which covers the impeller from the outside in a radial direction and forms a flow path of a working fluid together with the impeller. The flow path of the working fluid includes a diffuser flow path, a return bend part, and a return flow path. The diffuser flow path extends outward from the impeller in a radial direction and guides the working fluid ejected from an outlet of the impeller toward the outside in the radial direction. The return bend part is provided continuously with the outer sides of the diffuser flow path in the radial direction. The return bend part reverses the flow direction of the working fluid from the outer side toward the inside in the radial direction. The return flow path is provided downstream from the return bend part. The return flow path guides the working fluid to an inlet of the impeller on the rear stage side.

For example, Patent Document 1 describes a constitution in which, in a centrifugal compressor, a plurality of diaphragms are disposed to be arranged inside an outer casing in an axial direction of a rotating shaft. In the constitution described in Patent Document 1, a return bend part is formed by diaphragms adjacent to each other in an axial direction and an outer casing disposed outside the diaphragms. Therefore, the diaphragms are provided to be arranged on one side and the other side in the axial direction form a part of a curved portion of the return bend part. With such a constitution, when the centrifugal compressor is miniaturized, sizes of the diaphragms and the outer casing are also reduced. As a result, a large part of a curved surface of the return bend part is formed in the diaphragms instead of the outer casing.

Thus, in each of the diaphragms, a distal end portion formed between an outer circumferential surface and a curved surface is formed to have an acute angle and thus a region having a small thickness in the radial direction is formed in some cases. On the other hand, the distal end portion formed between the outer circumferential surface and the curved surface is rounded to secure a thickness so that the strength is not reduced due to the distal end portion formed to have too narrow an angle in some cases.

PATENT DOCUMENT

[Patent Document 1] Specification of United States Patent Application, Publication No. 2017/0030373

SUMMARY

However, when the distal end portion is rounded in this manner, a step difference is formed to protrude from the curved surface. The flow of a working fluid flowing through the return bend part is disturbed due to this step difference and a loss is generated in the flow of the working fluid. Particularly, when a step difference is formed on the downstream side of the return bend part, the flow of the working fluid is largely disturbed and a flow loss of the working fluid increases. For this reason, it is desirable to minimize a loss caused by the flow of the working fluid in the return bend part while securing the strength of the diaphragms.

The present disclosure provides a rotary machine and a diaphragm capable of minimizing a loss caused by a flow of a working fluid in a return bend part while securing the strength of the diaphragm.

A rotary machine according to a first aspect of the present disclosure includes: an impeller which is configured to rotate about an axis and by which a working fluid flowing from a first side in an axial direction in which the axis extends flows outward in a radial direction centered on the axis; and a casing part which is provided to surround the impeller and includes a flow path having a return bend part configured to reverse a flow direction of the working fluid flowing outward in the radial direction from the impeller toward the inside in the radial direction and to guide the working fluid formed therein, wherein the casing part includes: a plurality of diaphragms which have a cylindrical shape in which the diaphragms extend in the axial direction and have curved flow path formation surfaces forming a curved surface of the return bend part; and an outer casing which has a cylindrical shape in which the outer casing extends in the axial direction to cover the plurality of diaphragms from the outside in the radial direction and has a concave part recessed in an inner circumferential surface outward in the radial direction, the outer casing has an outer flow path formation surface which forms a part of the return bend part further outward in the radial direction than the curved flow path formation surface, the diaphragm has a convex part which protrudes from an outer circumferential surface outward in the radial direction to be engaged with the concave part, and a surface of the convex part facing in the axial direction extends from the curved flow path formation surface.

With such a constitution, the convex part is formed so that the surface facing the axial direction extends from the curved flow path formation surface. For this reason, the thickness in the radial direction of the distal end of the curved flow path formation surface increases by the thickness of the convex part. Since the convex part is engaged with the concave part, it is possible to prevent the distal end of the curved flow path formation surface on which the convex part is formed from protruding inward in the radial direction in the return bend part. Therefore, it is possible to prevent the working fluid flowing through the return bend part from colliding with the end portion of the diaphragm to generate a loss.

In the rotary machine according to a second aspect of the present disclosure, in the first aspect, the curved flow path formation surface may be curved in the axial direction from the inside in the radial direction toward a curved surface end portion which is an outer end portion in the radial direction, and the surface of the convex part facing the axial direction may extend from the curved surface end portion.

With such a constitution, the convex part is formed at the boundary between the outer flow path formation surface and the curved flow path formation surface which form a region on the downstream side of the return bend part. For this reason, it is possible to prevent the occurrence of the loss caused by a flow disturbance in a region on the downstream side of the return bend part in which the process gas is easily collected on the outer side in the radial direction. Therefore, it is possible to effectively prevent the loss caused by the flow of the process gas in the return bend part.

In a rotary machine according to a third aspect of the present disclosure, in the first or second aspect, when the concave part is set as a first concave part, the outer casing may further include a second concave part which is recessed from the inner circumferential surface outward in the radial direction at a position away from the first concave part, when the convex part is set as a first convex part, the diaphragm may further include a second convex part which protrudes from the outer circumferential surface outward in the radial direction to be engaged with the second concave part, and a dimensional tolerance between the second concave part and the second convex part in the axial direction may be smaller than a dimensional tolerance between the concave part and the convex part in the axial direction.

With such a constitution, it is possible to position a position of the diaphragm in the axial direction with respect to the outer casing by the second concave part and the second convex part which have a small dimensional tolerance in the axial direction instead of the first concave part and the first convex part. Therefore, it is possible to prevent the first convex part from being deformed due to the applied load and distorting the shape of the return bend part.

In a rotary machine according to a fourth aspect of the present disclosure, in the third aspect, the second convex part may be disposed at an intermediate portion of the diaphragm in the axial direction.

With such a constitution, it is possible to position the diaphragm in the axial direction in the middle of the axial direction. Therefore, when deformation (displacement) in the axial direction occurs in the diaphragm due to thermal expansion or the like, the displacement in the axial direction at the end portions on both sides in the axial direction is substantially equalized.

In a rotary machine according to a fifth aspect of the present disclosure, in any one of the first to fourth aspects, the outer flow path formation surface may be a continuous surface which is integrally formed with the inner circumferential surface of the outer casing.

A diaphragm according to a sixth aspect of the present disclosure is a diaphragm of a rotary machine including: an impeller which is configured to rotate about an axis and by which a working fluid flowing from a first side in an axial direction in which the axis extends flows outward in a radial direction centered on the axis; and a casing part which is provided to surround the impeller and includes a flow path having a return bend part configured to reverse a flow direction of the working fluid flowing outward in the radial direction from the impeller toward the inside in the radial direction and to guide the working fluid formed therein, in which the casing part includes: a plurality of diaphragms which have cylindrical shapes in which the diaphragms extend in the axial direction and have curved flow path formation surfaces forming a curved surface of the return bend part; and an outer casing which has a cylindrical shape in which the outer casing extends in the axial direction to cover the plurality of diaphragms from the outside in the radial direction and has a concave part recessed in an inner circumferential surface outward in the radial direction, wherein the diaphragm has a convex part which protrudes from an outer circumferential surface outward in the radial direction to be engaged with the concave part, and a surface of the convex part facing the axial direction extends from the curved flow path formation surface.

According to the present disclosure, it is possible to minimize a loss caused by a flow of a working fluid in a return bend part while securing the strength of a diaphragm.

DETAILED DESCRIPTION

Embodiments for implementing a rotary machine and diaphragms according to the present disclosure will be described below with reference to the accompanying drawings. However, the present disclosure is not limited to only these embodiments.

Figure 1:
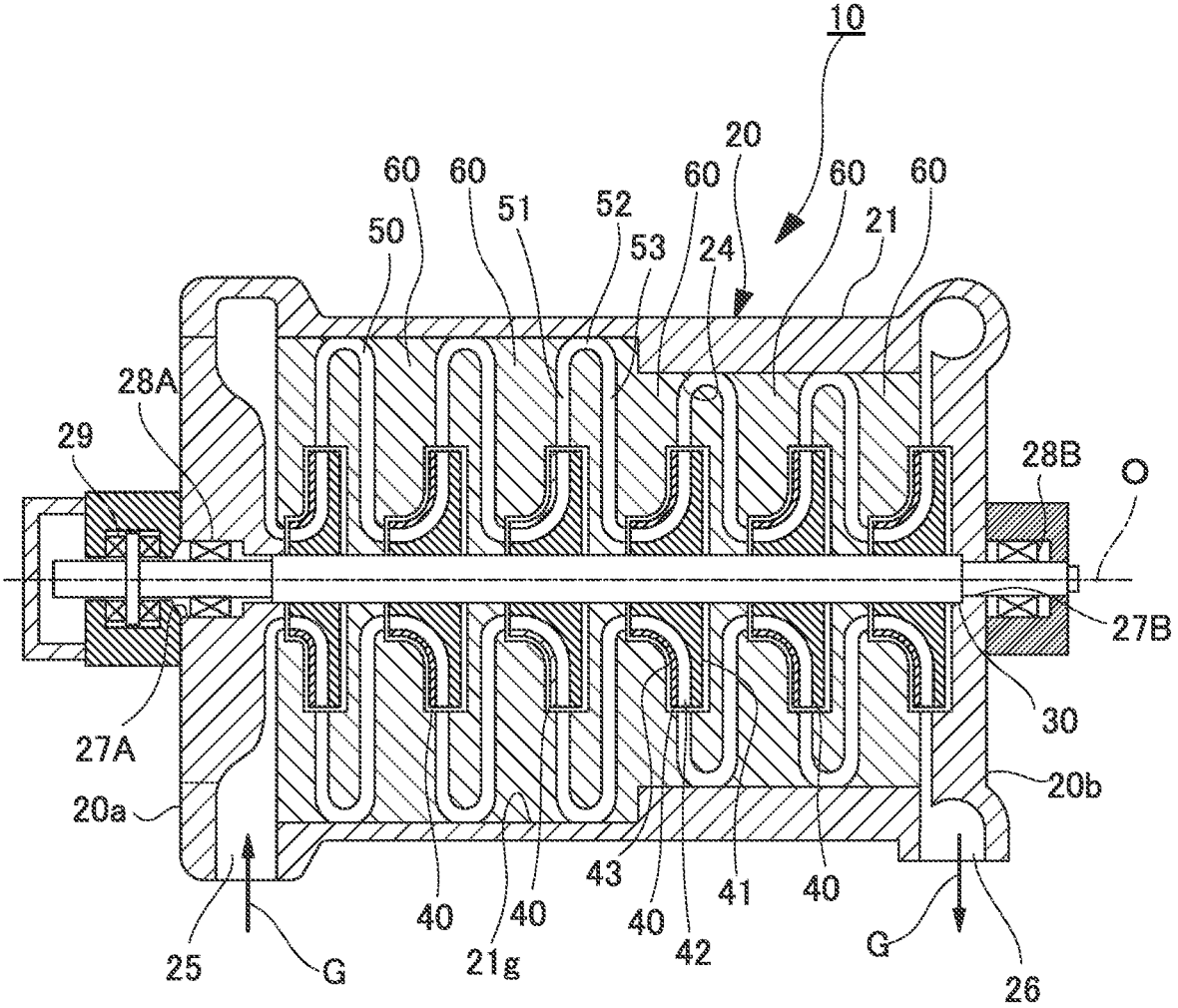
FIG. 1 is a cross-sectional view showing a constitution of a centrifugal compressor according to an embodiment of the present disclosure.
Figure 2:
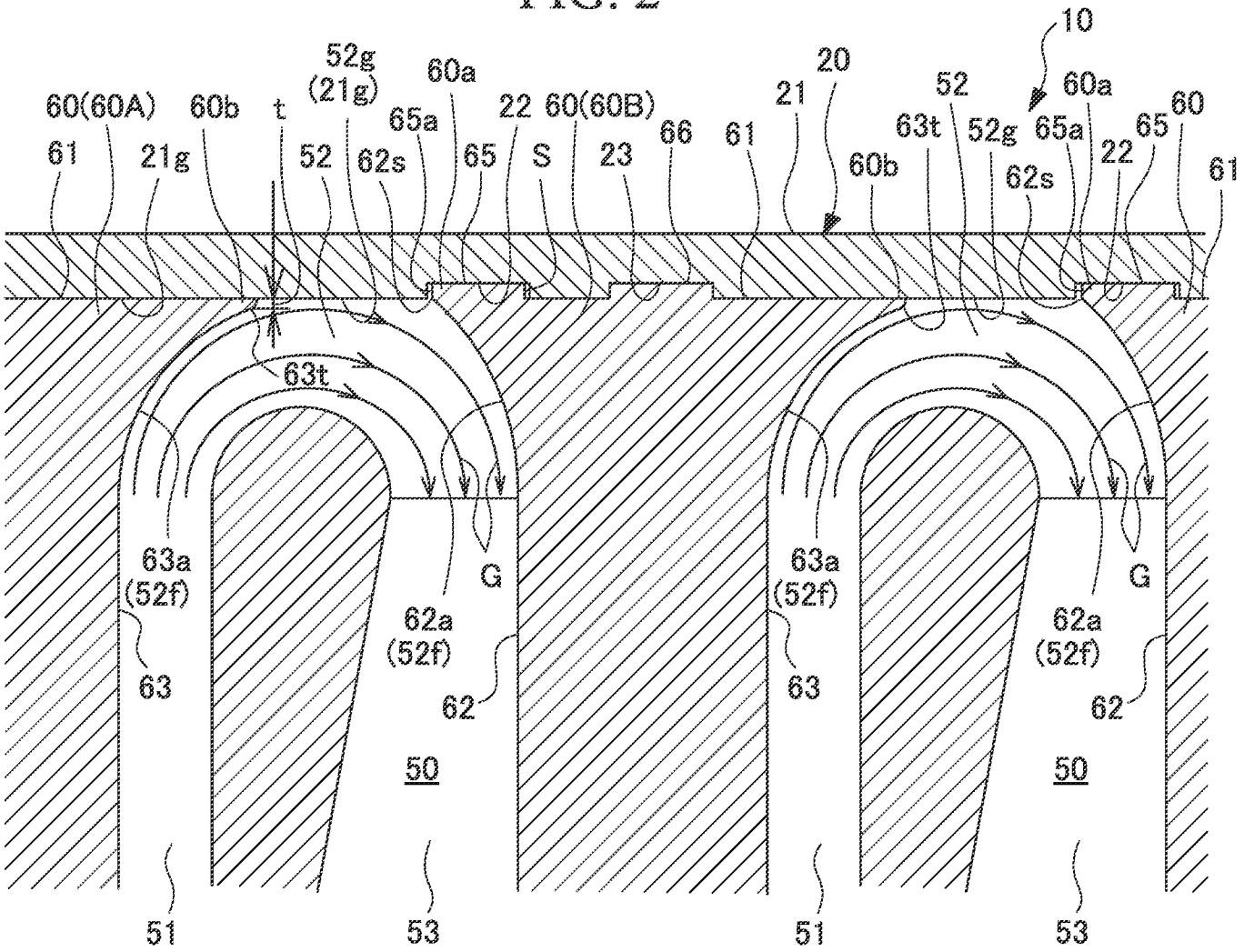
FIG. 2 is an enlarged cross-sectional view showing a main part of the centrifugal compressor.

FIG. 1 is a cross-sectional view showing a constitution of a centrifugal compressor according to an embodiment of the present disclosure. FIG. 2 is an enlarged cross-sectional view showing a main part of the centrifugal compressor.

As illustrated in FIG. 1, a centrifugal compressor (rotary machine) 10 which is the rotary machine in the embodiment mainly includes a casing part 20, a rotating shaft 30 which is rotatably supported in the casing part 20 around an axis O, and impellers 40 which are attached to the rotating shaft 30 and compress a process gas (working fluid) G using a centrifugal force.

The casing part 20 is provided to surround the impellers 40. The casing part 20 has an internal space 24 whose diameter repeatedly decreases and increases. The impellers 40 are accommodated in the internal space 24. In the casing part 20, a casing side flow path (flow path) 50 through which the process gas G flowing through the impellers 40 flows from the upstream side to the downstream side is formed at a position between the impellers 40 therein.

A suction port 25 through which the process gas G flows from the outside into the casing side flow path 50 is provided in one end portion 20*a* of the casing part 20. Furthermore, a discharge port 26 which is continuous to the casing side flow path 50 and through which the process gas G flows out to the outside is provided in the other end portion 20*b* of the casing part 20.

The one end portion 20*a* side and the other end portion 20*b* side of the casing part 20 have support holes 27A and 27B configured to support both end portions of the rotating shaft 30 formed therein. The rotating shaft 30 is rotatably supported by the support hole 27A via a journal bearing 28A around the axis O. The rotating shaft 30 is rotatably supported by the support hole 27B via a journal bearing 28B around the axis O. A thrust bearing 29 is further provided on the one end portion 20*a* of the casing part 20. An end of the rotating shaft 30 in an axial O direction in which the axis O extends is rotatably supported via the thrust bearing 29 in the axial O direction.

The impellers 40 are supported by the rotating shaft 30 to be rotatable around the axis O. The impellers 40 cause the process gas G flowing from a first side in the axial O direction (the one end portion 20*a* side of the casing part 20 or the upstream side in the axial O direction) to flow out to the outside in a radial direction centered on the axis O. The plurality of impellers 40 are accommodated inside diaphragms 60 in the casing part 20 at intervals in the axial O direction of the rotating shaft 30. It should be noted that, although a case in which six impellers 40 are provided is exemplified in FIG. 1, at least one impeller 40 may be provided. The impellers 40 are, for example, so-called closed impellers including disk parts 41, blade parts 42, and cover parts 43.

The casing part 20 in the embodiment includes an outer casing 21 which forms a compartment and the plurality of diaphragms 60 provided in the outer casing 21.

The outer casing 21 forms an external form of the centrifugal compressor 10. The outer casing 21 has a cylindrical shape in which the outer casing 21 extends in the axial O direction of the rotating shaft 30. The outer casing 21 has an outer casing inner circumferential surface 21*g* centered on the axis O. The outer casing 21 has a concave part which is recessed from the inner circumferential surface outward in the radial direction. The outer casing 21 has the plurality of diaphragms 60 accommodated therein.

The plurality of diaphragms 60 are arranged in the outer casing 21 in the axial O direction of the rotating shaft 30. The plurality of diaphragms 60 are arranged to be stacked in an axial direction. The diaphragms 60 have cylindrical shapes in which the diaphragms 60 extend in the axial O direction. The diaphragms 60 define a part of the casing side flow path 50 when connected to each other.

The casing side flow path 50 in the embodiment includes diffuser parts 51, return bend parts 52, and return flow paths 53.

The diffuser parts 51 extend outward in the radial direction from outer circumferential portions (outer sides in the radial direction) of the impellers 40. The diffuser parts 51 are flow paths which are linear in a radially cross-sectional view and extend in the radial direction.

The return bend parts 52 extend to be continuous to outer circumferential portions (outer sides in the radial direction) of the diffuser parts 51. The return bend parts 52 are curved to turn in a U shape in a cross-sectional view from the outer circumferential portions of the diffuser parts 51 toward the other end portion 20*b* side of the casing part 20 and extend inward in the radial direction. The return bend parts 52 reverse flow directions of the process gas G flowing outward in the radial direction from the impellers 40 inward in the radial direction and guide the process gas G.

The return flow paths 53 extend inward in the radial direction from the return bend parts 52. The process gas G flowing through the return bend parts 52 flows into the impellers 40 through the return flow paths 53. The return flow paths 53 linearly extend in a radially cross-sectional view inward in the radial direction and change a flow direction of the process gas G to a second side in the axial O direction (the other end portion 20*b* side of the casing part 20 and the downstream side in the axial O direction) in the inside in the radial direction.

In such a centrifugal compressor 10, the process gas G is introduced from the suction port 25 into the casing side flow path 50. The process gas G is compressed in the impellers 40 rotating about the axis O with the rotating shaft 30 and ejected from the inside in the radial direction to the outside in the radial direction.

The process gas G flowing out from each of the impellers 40 of each stage flows to the outside in the radial direction through the diffuser parts 51 of the casing side flow path 50, has flow directions that double back in the return bend parts 52, and is sent to each of the impellers 40 on the rear stage side through the return flow paths 53. Thus, the process gas G is compressed in multiple stages when passing through the impellers 40 provided in the multiple stages from the one end portion 20*a* side of the casing part 20 toward the other end portion 20*b* side and the casing side flow path 50 and is sent through the discharge port 26.

As illustrated in FIG. 2, in the centrifugal compressor 10, each of the diaphragms 60 has a diaphragm outer circumferential surface 61 centered on the axis O. The diaphragm outer circumferential surface 61 faces an outer casing inner circumferential surface 21*g* of the outer casing 21. The diaphragm outer circumferential surface 61 in the embodiment is a surface parallel to the outer casing inner circumferential surface 21*g*. The diaphragms 60 have curved flow path formation surfaces 52*f* which form curved surfaces of the return bend parts 52. The curved flow path formation surfaces 52*f* are curved in the axial O direction from the inside in the radial direction toward an outer end portion in the radial direction.

The diaphragms 60 have upstream side flow path formation surfaces 62 on upstream side end portions 60*a* which are end portions on the upstream side in the axial O direction facing the one end portion 20*a* side of the casing part 20 (the left side on the paper surface in FIG. 2). The upstream side flow path formation surfaces 62 form a part of the casing side flow path 50 through which the process gas G flows in the centrifugal compressor 10. The upstream side flow path formation surfaces 62 define a part of the return bend parts 52 and the return flow paths 53. The upstream side flow path formation surfaces 62 have upstream side curved surfaces 62*a* which form a part of the curved flow path formation surfaces 52*f* of the return bend parts 52 on the outer side in the radial direction. The upstream side curved surfaces 62*a* form downstream sides of the return bend parts 52. The upstream side curved surfaces 62*a* are curved toward the upstream side in the axial O direction from the inside in the radial direction toward the outer end portion in the radial direction. The upstream side curved surfaces 62*a* are smooth curved surfaces with no step difference. Distal ends (curved surface end portions) 62*s* which are outer end portions in the radial direction of the upstream side curved surfaces 62*a* in the upstream side end portions 60*a* of the diaphragms 60 are in the same position in a position in the radial direction as the outer casing inner circumferential surface 21*g* of the outer casing 21.

Also, the diaphragms 60 have downstream side flow path formation surfaces 63 on downstream side end portions 60*b* which are end portions on the downstream side in the axial O direction facing the other end portion 20*b* side of the casing part 20 (the right side on the paper surface in FIG. 2). The downstream side flow path formation surfaces 63 form a part of the casing side flow path 50 through which the process gas G flows in the centrifugal compressor 10. The downstream side flow path formation surfaces 63 define a part of the diffuser parts 51 and the return bend parts 52. The downstream side flow path formation surfaces 63 have downstream side curved surfaces 63*a* which form a part of the curved flow path formation surfaces 52*f* of the return bend parts 52 on the outer side in the radial direction. The downstream side curved surfaces 63*a* form the upstream sides of the return bend parts 52. The downstream side curved surfaces 63*a* are curved toward the downstream side in the axial O direction from the inside in the radial direction toward the outer end portion in the radial direction. Distal end portions 63*t* of the downstream side curved surfaces 63*a* in the downstream side end portions 60*b* of the diaphragms 60 have an R shape to be rounded. Therefore, outer end portions in the radial direction (curved surface end portion) of smooth curved surfaces in the downstream side curved surfaces 63*a* are located inward in the radial direction of the diaphragm outer circumferential surface 61. Thus, in the distal end portions 63*t* of the downstream side curved surfaces 63*a*, the diaphragms 60 have a predetermined thickness t in the radial direction.

The outer casing 21 has an outer flow path formation surface 52*g* which forms a part of the return bend parts 52 further outward in the radial direction than the curved flow path formation surfaces 52*f*. The outer flow path formation surface 52*g* is a smooth continuous surface which is integrally formed with the outer casing inner circumferential surface 21*g*. The outer flow path formation surface 52*g* is linearly formed to be continuous to the outer casing inner circumferential surface 21*g* in a radially cross-sectional view. The outer casing 21 has a first concave part (concave part) 22 and a second concave part 23 which are recessed in the outer casing inner circumferential surface 21*g*.

The first concave part 22 is recessed in the outer casing inner circumferential surface 21*g* outward in the radial direction. The first concave part 22 in the embodiment is vertically recessed in an end portion on the downstream side of the outer flow path formation surface 52*g* facing the axial O direction.

The second concave part 23 is recessed in the outer casing inner circumferential surface 21*g* outward in the radial direction at a position away from the first concave part 22. The second concave part 23 in the embodiment is vertically recessed in the outer casing inner circumferential surface 21*g* closer to the downstream side in the axial O direction than the first concave part 22.

The diaphragms 60 have first convex parts (convex parts) 65 and second convex parts 66 which protrude from the diaphragm outer circumferential surface 61.

The first convex parts 65 protrude from the diaphragm outer circumferential surface 61 outward in the radial direction at the upstream side end portions 60*a* of the diaphragms 60. Each of the first convex parts 65 is engaged with each of the first concave parts 22. The first convex part 65 protrude from the diaphragm outer circumferential surface 61 to have a rectangular cross section in a radially cross-sectional view. An upstream surface 65*a* of the first convex part 65 facing the upstream side in the axial O direction extends from the curved flow path formation surfaces 52*f*. The upstream surface 65*a* in the embodiment is a surface perpendicular to the axis O. The upstream surface 65*a* extends outward in the radial direction from a distal end 62*s* which is an outer end portion of each of the upstream side curved surfaces 62*a* in the radial direction.

Each of the second convex parts 66 is formed at a position away from each of the first convex parts 65 on the downstream side in the axial O direction on the diaphragm outer circumferential surface 61. The second convex part 66 is disposed at an intermediate portion of the diaphragm 60 in the axial O direction. The second convex part 66 protrudes outward in the radial direction. The second convex part 66 is formed at a position facing the second concave part 23 in the radial direction. The second convex part 66 is engaged with the second concave part 23. The second convex part 66 protrudes from the diaphragm outer circumferential surface 61 to have a rectangular cross section in a radially cross-sectional view.

A dimensional tolerance between the second concave part 23 and the second convex part 66 in the axial O direction is smaller than a dimensional tolerance between the first concave part 22 and the first convex part 65 in the axial O direction. For example, the second concave part 23 and the second convex part 66 are set to have a dimensional tolerance obtained when the second concave part 23 and the second convex part 66 are fitted to each other in the axial O direction. When the second concave part 23 and the second convex part 66 are engaged with each other, the diaphragm 60 is positioned in the axial O direction with respect to the outer casing 21. On the other hand, the first concave part 22 and the first convex part 65 are set to have a dimensional tolerance so that the first concave part 22 and the first convex part 65 have, for example, a gap S of about 0.5 mm in the axial O direction. The first concave part 22 and the first convex part 65 absorb deformation (displacement) in the axial O direction caused in the diaphragm 60 due to thermal expansion or the like when the centrifugal compressor 10 operates.

Thus, different diaphragms 60 are located on the upstream side in the axial O direction and the downstream side in the axial O direction with respect to each return bend part 52. Here, a diaphragm 60 located on the upstream side in the axial O direction with respect to one return bend part 52 is set to be a first diaphragm 60A. Furthermore, a diaphragm 60 located on the downstream side in the axial O direction with respect to one return bend part 52 is set to be a second diaphragm 60B.

The downstream side end portion 60*b* of the first diaphragm 60A and the upstream side end portion 60*a* of the second diaphragm 60B are disposed at intervals in the axial O direction. A part of the outer casing inner circumferential surface 21*g* of the outer casing 21 is exposed between the downstream side end portion 60*b* of the first diaphragm 60A and the upstream side end portion 60*a* of the second diaphragm 60B. The exposed part of the outer casing inner circumferential surface 21*g* is the outer flow path formation surface 52*g* which forms a part of a flow path of each of the return bend parts 52.

In such a constitution, a thickness in the radial direction of the second diaphragm 60B located on the other end portion 20*b* side with respect to the return bend part 52 increases by forming the first convex part 65 on the upstream side end portion 60*a*. Since the first convex part 65 is engaged with the first concave part 22 in the outer casing 21, the upstream side end portion 60*a* in the second diaphragm 60B is prevented from protruding inward in the radial direction from the outer casing inner circumferential surface 21*g* of the outer casing 21. To be specific, in the upstream side end portion 60*a* in the second diaphragm 60B, the distal end 62*s* of the upstream side curved surface 62*a* does not protrude inward in the radial direction from the outer casing inner circumferential surface 21*g* of the outer casing 21. Therefore, the process gas G flowing through the return bend part 52 smoothly flows without a flow disturbance by the upstream side end portion 60*a* of the second diaphragm 60B.

According to the centrifugal compressor 10 and the diaphragm 60 as described above, the first convex part 65 is formed so that the upstream surface 65*a* extends vertically from the distal end 62*s* of the upstream side curved surface 62*a*. For this reason, the thickness of the distal end 62*s* in the radial direction increases by the thickness of the first convex part 65. Since the first convex part 65 is engaged with the first concave part 22 in the outer casing 21, the distal end 62*s* of the upstream side end portion 60*a* can be prevented from protruding inward in the radial direction into the return bend part 52. Therefore, it is possible to prevent the occurrence of the loss caused by a flow disturbance by collision of the process gas G flowing through the return bend part 52 at a boundary between the outer flow path formation surface 52*g* and the upstream side curved surface 62*a*. As a result, it is possible to secure the strength of the diaphragm 60 and to prevent the loss caused by a flow of the process gas G in the return bend part 52.

Also, the return bend part 52 is formed when the outer flow path formation surface 52*g* is sandwiched by the upstream side curved surface 62*a* and the downstream side curved surface 63*a* from both sides in the axial O direction. In such a constitution, when the first convex part 65 is formed on the upstream side end portion 60*a* of the second diaphragm 60B, the first convex part 65 is formed at a boundary between the outer flow path formation surface 52*g* and the upstream side curved surface 62*a* which form a region on the downstream side of the return bend part 52. For this reason, it is possible to prevent the occurrence of the loss caused by a flow disturbance in a region on the downstream side of the return bend part 52 in which the process gas G is easily collected on the outer side in the radial direction. Therefore, it is possible to effectively prevent the loss caused by the flow of the process gas G in the return bend part 52.

Also, the distal end 62*s* of the upstream side curved surface 62*a* in the upstream side end portion 60*a* is located at the same position as the outer casing inner circumferential surface 21*g* of the outer casing 21 in the radial direction. With such a constitution, a surface which forms the return bend part 52 is formed without protruding inward in the radial direction. Therefore, it is possible to more effectively prevent the loss caused by the process gas G flowing through the return bend part 52.

When the second concave part 23 and the second convex part 66 which have a small dimensional tolerance in the axial direction are engaged with each other, it is possible to position a position of the diaphragm 60 in the axial O direction with respect to the outer casing 21 by the second concave part 23 and the second convex part 66 instead of the first concave part 22 and the first convex part 65. Thus, it is possible to prevent the first convex part from being deformed due to the applied load and distorting the shape of the return bend part 52. Therefore, it is possible to further more effectively prevent the loss caused by the process gas G flowing through the return bend part 52.

In addition, the diaphragm 60 can be positioned in the axial O direction in the middle of the axial O direction by the second concave part 23 and the second convex parts 66. Therefore, when deformation in the axial O direction is generated in diaphragm 60 due to thermal expansion or the like, it is possible to substantially equalize displacement in the axial O direction of end portions on both sides in the axial O direction of the diaphragm 60. For this reason, it is possible to position the diaphragm 60 in the axial O direction with respect to the outer casing 21 with high accuracy.

A gap S is formed between the first convex part 65 and the first concave part 22 in the axial O direction. Thus, when thermal expansion in the axial O direction is generated in the diaphragm 60, it is possible to prevent the first convex part 65 and the first concave part 22 from interfering with each other.

Although the embodiments of the present disclosure have been described in detail above with reference to the drawings, the constitutions of the embodiments, the combinations thereof, and the like are merely examples and additions, omissions, substitutions, and other changes of the constitutions are possible without departing from the gist of the present disclosure. Furthermore, the present disclosure is not limited by the embodiments, and is limited only by the scope of the claims.

For example, although the first convex part 65 is provided to be continuous to the distal end 62*s* of the upstream side curved surface 62*a* configured to manage the downstream side of the return bend part 52 in the embodiment, the present disclosure is not limited to such a constitution. For example, the first convex part 65 may be provided to be continuous to the distal end portion 63*t* of the downstream side curved surface 63*a*. At that time, the distal end portion 63*t* of the downstream side curved surface 63*a* does not have an R shape and is disposed at the same position as the outer casing inner circumferential surface 21*g* of the outer casing 21 in the radial direction.

The first convex part 65 is not limited to a structure in which only one first convex part 65 is provided to the diaphragm 60 to be continuous to the distal end 62*s* of the upstream side curved surface 62*a*. For example, a convex part provided to be continuous to the distal end portion 63*t* of the downstream side curved surface 63*a* may be provided in addition to the first convex part 65 continuous to the distal end 62*s* of the upstream side curved surface 62*a*.

In addition, although only one diaphragm group composed of the plurality of diaphragms 60 is provided in the casing part 20 in the embodiment, a plurality of diaphragm groups may be provided. Therefore, the rotary machine may be a multi-stage centrifugal compressor of a type in which the process gas G is suctioned from both sides in the axial O direction.

EXPLANATION OF REFERENCES

10 Centrifugal compressor (rotary machine)
20 Casing part
20*a* One end portion
20*b* The other end portion
21 Outer casing
21*g* Outer casing inner circumferential surface
22 First concave part (concave part)
23 Second concave part
24 Internal space
25 Suction port
26 Discharge port
27A Support hole
27B Support hole
28A Journal bearing
28B Journal bearing
29 Thrust bearing
30 Rotating shaft
40 Impeller
41 Disk part
42 Blade part
43 Cover part
50 Casing side flow path (flow path)
51 Diffuser part
52 Return bend part
52*f* Curved flow path formation surface
52*g* Outer flow path formation surface
53 Return flow path
60 Diaphragm
60A First diaphragm
60B Second diaphragm
60*a* Upstream side end portion
60*b* Downstream side end portion
61 Diaphragm outer circumferential surface
62 Upstream side flow path formation surface
62*a* Upstream side curved surface
62*s* Distal end
63 Downstream side flow path formation surface
63*a* Downstream side curved surface
63*t* Distal end portion
65 First convex part (convex part)
65*a* Upstream surface
66 Second convex part G Process gas (working fluid)
O Axis
S Gap
t Thickness

What is claimed is:

1. A rotary machine, comprising:

an impeller which is configured to rotate about an axis and by which a working fluid flowing from a first side in an axial direction in which the axis extends flows outward in a radial direction centered on the axis; and a casing part which is arranged to surround the impeller and includes a flow path having a return bend part configured to reverse a flow direction of the working fluid flowing outward in the radial direction from the impeller toward the inside in the radial direction and to guide the working fluid formed therein, wherein the casing part includes:

a plurality of diaphragms which have a cylindrical shape in which the diaphragms extend in the axial direction and have a curved flow path formation surface forming a curved surface of the return bend part; and an outer casing which has a cylindrical shape in which the outer casing extends in the axial direction to cover the plurality of diaphragms from the outside in the radial direction and has a concave part recessed in an inner circumferential surface outward in the radial direction, the outer casing has an outer flow path formation surface which forms a part of the return bend part further outward in the radial direction than the curved flow path formation surface, at least one of the plurality of diaphragms has a convex part which protrudes from an outer circumferential surface outward in the radial direction to be engaged with the concave part, a surface of the convex part in the axial direction extends from the curved flow path formation surface, the concave part is a first concave part, the outer casing further includes a second concave part which is recessed from the inner circumferential surface outward in the radial direction at a position away from the first concave part, the convex part is a first convex part, at least one of the plurality of diaphragms further includes a second convex part which protrudes from the outer circumferential surface outward in the radial direction to be engaged with the second concave part, and a dimensional tolerance between the second concave part and the second convex part in the axial direction is smaller than a dimensional tolerance between the first concave part and the first convex part in the axial direction.

2. The rotary machine according to claim 1, wherein the curved flow path formation surface is curved in the axial direction from the inside in the radial direction toward a curved surface end portion which is an outer end portion in the radial direction, and the surface of the convex part facing the axial direction extends from the curved surface end portion.

3. The rotary machine according to claim 2, wherein the outer flow path formation surface is a continuous surface which is integrally formed with the inner circumferential surface of the outer casing.

4. The rotary machine according to claim 1, wherein the second convex part is disposed at an intermediate portion of the at least one of the plurality of diaphragms in the axial direction.

5. The rotary machine according to claim 4, wherein the outer flow path formation surface is a continuous surface which is integrally formed with the inner circumferential surface of the outer casing.

6. The rotary machine according to claim 1, wherein the outer flow path formation surface is a continuous surface which is integrally formed with the inner circumferential surface of the outer casing.

* * * * *